US005934549A

United States Patent [19]

Baumgärtner et al.

[11] Patent Number: 5,934,549

[45] Date of Patent: Aug. 10, 1999

[54] CONVERTIBLE FOLDING BOX

[76] Inventors: Manfred Baumgärtner, Kantstrasse 16, 70193 Stuttgart; Karl-Ulrich Von Bischopinck, Alte Dorfstrasse 16, 70599 Stuttgart, both of Germany

[21] Appl. No.: 08/890,720

[22] Filed: Jul. 9, 1997

[30] Foreign Application Priority Data

Jul. 9, 1996 [DE] Germany ..... 196 27 649

[51] Int. Cl.[6] ..... B65D 5/20

[52] U.S. Cl. ..... 229/103.2; 206/459.5; 229/92.8; 229/143; 229/150; 229/921

[58] Field of Search ..... 229/92.8, 103.2, 229/142.143, 150, 178, 921, 103.3; 206/424, 459.5

[56] References Cited

U.S. PATENT DOCUMENTS

| | | | |
|---|---|---|---|
| Re. 33,503 | 12/1990 | Schluger . | |
| 930,882 | 8/1909 | Perkins | 229/178 |
| 2,011,703 | 8/1935 | Barker | 229/921 |
| 2,359,679 | 10/1944 | Roehrl . | |
| 2,389,580 | 11/1945 | Skell | 229/150 |
| 3,468,469 | 9/1969 | Kossoff et al. | 229/143 |
| 4,046,311 | 9/1977 | Voytko . | |
| 4,535,929 | 8/1985 | Sherman et al. . | |
| 4,560,102 | 12/1985 | Dlugopolski | 229/103.3 |
| 5,018,663 | 5/1991 | Corso . | |

FOREIGN PATENT DOCUMENTS

| | | |
|---|---|---|
| 1998476 | 8/1968 | Germany . |
| 2815046 | 11/1978 | Germany . |
| 80 20 660 | 11/1980 | Germany . |
| 43 13 108 | 10/1994 | Germany . |
| 44 18821 | 12/1995 | Germany . |

*Primary Examiner*—Gary E. Elkins
*Attorney, Agent, or Firm*—Patrick D. Kelly

[57] ABSTRACT

A new type of folding box is disclosed, which is designed for redispatching to a second location, after it has been received at a first location. This box, which can be made from a single flat pre-cut blank, of cardboard or other suitable material, has two lids: an inner lid, and an outer lid. The outer lid is printed, stamped, or affixed with advertising information, a first mailing address, or other useful lettering, to facilitate a first delivery or sale. The inner lid, which is initially covered and preferably hidden by the outer lid, is printed or stamped with a second lettering, such as a second mailing or delivery address. The user purchases or otherwise receives the complete box, including the outer lid, and carries out any desired function with the contents of that box. For example, if the box contains collection jars, for holding blood, hair, water, or soil samples, the user would fill the jars with such samples or specimens. The customer then tears off the outer lid, thereby exposing the inner lid, which has the mailing address for the manufacturer, laboratory, or other intended location. This conveniently creates a redispatch packaging which suffers little or no risk of being misdirected. If desired, the box can be unfolded and flattened by a user, for space-saving storage until it is needed.

7 Claims, 1 Drawing Sheet

CONVERTIBLE FOLDING BOX

RELATED FOREIGN APPLICATION

This application claims the priority of German Patent Application No. 196 27 649.7, filed on Jul. 9, 1996, which is incorporated herein by reference.

BACKGROUND OF THE INVENTION

1. Field of the Invention

The present invention relates to a convertible folding box with which a lettering suitable for redispatching is already integrated into the folding box and the folding box is convertible into a redispatch packaging.

2. Description of the Prior Art

Folding boxes made of cardboard or similar materials are widely employed as packaging, for protecting, presenting, and shipping products. In many cases, a product can be presented and locked in position within its box by means of one or more inset devices (made of styrofoam, cardboard, or other suitable material) inserted into the box. As used herein, "folding box" refers to boxes that can be initially stacked and handled in a collapsed configuration, which is relatively flat (usually with a thickness of only 1 or 2 sheets of cardboard). Such boxes are usually manufactured and then bundled together (while lying flat) in large bundles (such as sets of 20, 50, or 100), for shipping to the company that wants to use the boxes to hold its products. The user company then assembles the boxes into a product-holding configuration, and inserts its products into the boxes. If desired, such boxes can be secured in a product-holding position by means such as staples, glue, or adhesive tape, at one or more locations, or by means such as inserting protruding tabs into accommodating slots.

Large quantities of folding box packaging are disposed of by customers after buying products, but that is not always the case. For example, many products (especially high-value products, such as electronic equipment) require purchasers to keep any packaging material, in case a broken or defective item must be returned for repair or replacement; in such cases, the consumer usually must re-pack the product carefully, in the original folding box, and send it back. In addition, some manufacturers are willing to take back and either reuse or recycle folding box containers.

This invention is concerned with folding boxes that are designed for "redispatching". As used herein, "redispatch" is used broadly, and includes the process of forwarding or otherwise sending or delivering a package to a second location, after it has been received at a first location. Such forwarding can be carried out in various ways, such as (1) mailing or shipping, using a government postal agency or a private delivery service; (2) interoffice delivery, of items such as company records or medical samples; and (3) transporting items (such as used or defective merchandise, empty bottles, medical samples, etc.) to a store, warehouse, laboratory, or other facility. These are merely examples; the particular method of redispatching an item to a new location is not crucial to this invention.

Various boxes designed for redispatching have been previously created, but all items known in the prior art suffer from one or more drawbacks. For example, German patent DE 43 13 108 A1 discloses a convertible folding box with a first and a second lid, for closure of the box. The first lid is provided with a first address for dispatching, and the second lid is provided with a second address for redispatching. In use, this box suffers from a risk that the first and the second addresses might be unintentionally mixed up; a person handling the box may be faced with either of two addresses, and may not know which address is the correct one. To prevent such confusion, special care must be taken by a sender, to ensure that confusion cannot and does not arise.

The use of a convertible box within the context of a shuttle system for dispatching medical samples is disclosed in DE 28 15 046 A1. This box also is provided with two closing lids which are mutually foldable one above the other. Both closing lids are provided with holes, allowing for connection of the lids by means of press buttons, to prevent an outer lid from opening unintentionally, during transport.

German utility model no. 19 98 476, on the other hand, concerns a gift box provided with a picture postcard as an add-on benefit. The postcard is hinged to one of the side panels of the box and is foldable above one of the other panels or the lid of the box. The add-on benefit of this box resides in that the postcard can be torn off the box and used otherwise.

Boxes that can be converted into a new form by tearing off parts of the boxes, and refolding the remaining components, are also known, in general. For example, German patent DE 44 18 821 A1 discloses a packing drum for cigarette boxes, which can be converted into an individual cigarette box by tearing off certain parts of it and refolding the remaining portion.

SUMMARY OF THE INVENTION

The invention provides a folding box for presenting or dispatching a product, which can be converted easily for safe and secure redispatching, with no possibility of confusing the intended second address with an earlier, initial address.

In particular, the invention provides a folding box type of packaging for a product (such as a medical sampling set) that is designed for display and purchase in a retail setting, such as a store, drugstore, and the like. Initially, the packaging is designed and suited for presenting and advertising the product in the store. When the package is properly manipulated by a purchaser or other user, it becomes suited for shipping the product (in modified form, if desired) to an address that was stamped or printed on (or otherwise affixed to) the packaging, preferably on an inner lid that does not become visible until after the package has been manipulated by a user.

The convertible folding box, according to the invention, comprises:

a bottom panel, side walls rising from the bottom panel, an outer lid linked with one of the side walls via a first folding border, allowing the lid to close the volume formed by the bottom panel and the side walls; and, at least one inner lid, which is provided with a stamped, printed, or otherwise affixed address, instructions, or other information that enables and facilitates redispatching, and which is also linked with one of the side walls via a second folding border, and which, during initial shipping and handling of the box, is positioned below the outer lid, so that, preferably, it cannot be seen during initial shipping, handling, and display of the box.

The first folding border is provided with a perforated or otherwise weakened border. This allows the outer lid to be torn off conveniently, without requiring any scissors, blades, or other tools, thereby removing from the box any address, advertising information, or other information that was printed or stamped on (or otherwise affixed to) the outer label. This prevents any risk of obscuring or confusing the redispatching address (on the inner lid) with any initial advertising, address, or other information that was provided on the outer lid.

The consumption of packaging material can be halved by the newly formed folding box, which, according to the invention, after its first use is usable again in its new form. The multiple usability offers convenience, both by reducing the amount of waste disposal, and by reduced handling requirements if the folding box is to be redispatched.

According to the invention, the folding box disclosed herein has at least two lids. A return address, such as the address of the manufacturer, is preferably already printed, stamped, or otherwise affixed (by means such as adhesive labels) on the inner lid. If desired, space can also be provided for the sender's address, so that the sender will be prompted to fill in his address. In addition, postal information or various other notes of use or instruction may be printed on it, in advance, in order to further simplify handling.

In the folded state of the box, the outer lid on which a product advertisement is displayed is placed above the inner lid. This outer lid may preferably be torn off the box simply by hand without using or requiring any tools or other aids, such as scissors or a knife.

In one preferred embodiment, at least one area of the first folding border is excluded from the perforated border, and a tongue is left behind, within an area of the folding border excluded from the portion of the outer lid that is removed when the perforated border is torn. After the outer lid has been removed, the tongue which remains behind can be inserted into an accommodating slot, to help secure closure of the box.

In a preferred embodiment, the complete folding box disclosed herein can be made out of a single piece of cardboard (or other suitable material), without requiring any adhesive to hold the box together after assembly into a product-holding configuration. For example, the box can be folded up and affixed in the desired configuration, by inserting flaps, provided on the side panels, into accommodating slots. If desired, the side panels may have finger holes or other means to allow a user to completely unfold the box again, to store the box in flattened form which requires extremely little space, until the user wishes to assemble the box again into a volume-containing configuration. Instructions to facilitate assembly and disassembly can also be printed on the box.

The folding box disclosed herein serves, in a first preferred application, as a container for holding and transporting watertight plastic or glass containers, which can be used for purposes such as obtaining and transporting medical specimens or samples, soil or water samples, and the like, either before or after analysis or other such use. Such boxes can be used in, for example, medical testing kits that are sold to consumers at pharmacies, drugstores, or clinics, and soil or water testing kits that are sold at farming supply stores, hardware stores, plant nurseries, and the like. When used for purposes such as this, the outer lid can display a product advertisement designed to draw the attention of potential buyers. The product in this type of use will comprise (1) any physical devices, such as containers, collection tools, instructions, or similar components, combined with (2) a scientific testing service, which will be carried out at a laboratory is run by or under contract to the company which sells the testing kit.

The customer buys the kit in the original box (with the exposed outer lid), and carries out the collection or sampling work. He then must send the collected sample(s) to the proper laboratory, for analysis. To simplify this task, and to eliminate any risk that the valuable samples might be lost or mishandled, the customer simply tears off the outer lid, and uses the inner lid (which previously was hidden) to reclose the box. The inner lid will clearly display the name and address of the laboratory to which the samples will then be sent, in a manner which makes it clear that the name and address of the laboratory provide the mailing address of the box that contains the sample. The customer can affix any necessary postage; alternately, the inner label can have, pre-printed in the upper right corner, a business mailing permit which eliminates the need for any added postage (and which also eliminates any risk that glued-on stamps might fall off or be taken off). The reformed package containing the samples is then sent to the laboratory, where it is analyzed, and the scientific results are provided to the customer by means of a letter, phone call, etc.

In an alternate use, a folding box as disclosed herein might be designed to contain one or more personal items (such as a photograph of a person, a pet, or a treasured possession) which will be mailed or shipped, by a customer, to a commercial location. At the commercial location, the photograph or other possession which belongs to the customer will be converted into a new form (such as, for example, a coffee mug, a plaque or poster, or an item of clothing), with the picture permanently emblazoned on it. The new item containing the picture will then be returned to the customer. In this type of arrangement, the customer could purchase the original box, inside an outer wrapper which can be discarded or recycled. Once the selected picture has been inserted into the box, the customer writes his or her address on the inner lid, making sure that it is spelled correctly and has exact and correct postal codes. The customer then closes the box, with the outer lid exposed. The outer lid contains the address that the photograph is to be mailed to, and it can provide a business mailing permit if desired, the cost of which would be included in the total cost of the service. When the box arrives at the commercial location, where it will be converted into a new item which is more valuable to the customer, the service workers can tear off the outer lid, and close the box using the inner lid, which will then display the address of the customer, for mailing or shipping.

The folding box disclosed herein can also serve in another preferred use, as a dispatch container for machine-readable data media, such as computer-readable floppy disks, CD-ROM's and the like. This way, such data can be reciprocally exchanged between a sender and receiver, to avoid transfers via computer networks, which create risks with regard to data safety and confidentiality. The use of such boxes in the context of such shuttle systems can be advantageous to software suppliers, banks, and other safety sensitive branches.

Therefore, the new folding box disclosed herein can reduce waste, and can promote convenience for users, and security for the contents of such boxes. Manufacturers, service providers, and customers can all benefit accordingly.

DESCRIPTION OF A PREFERRED EMBODIMENT

Figure 1:
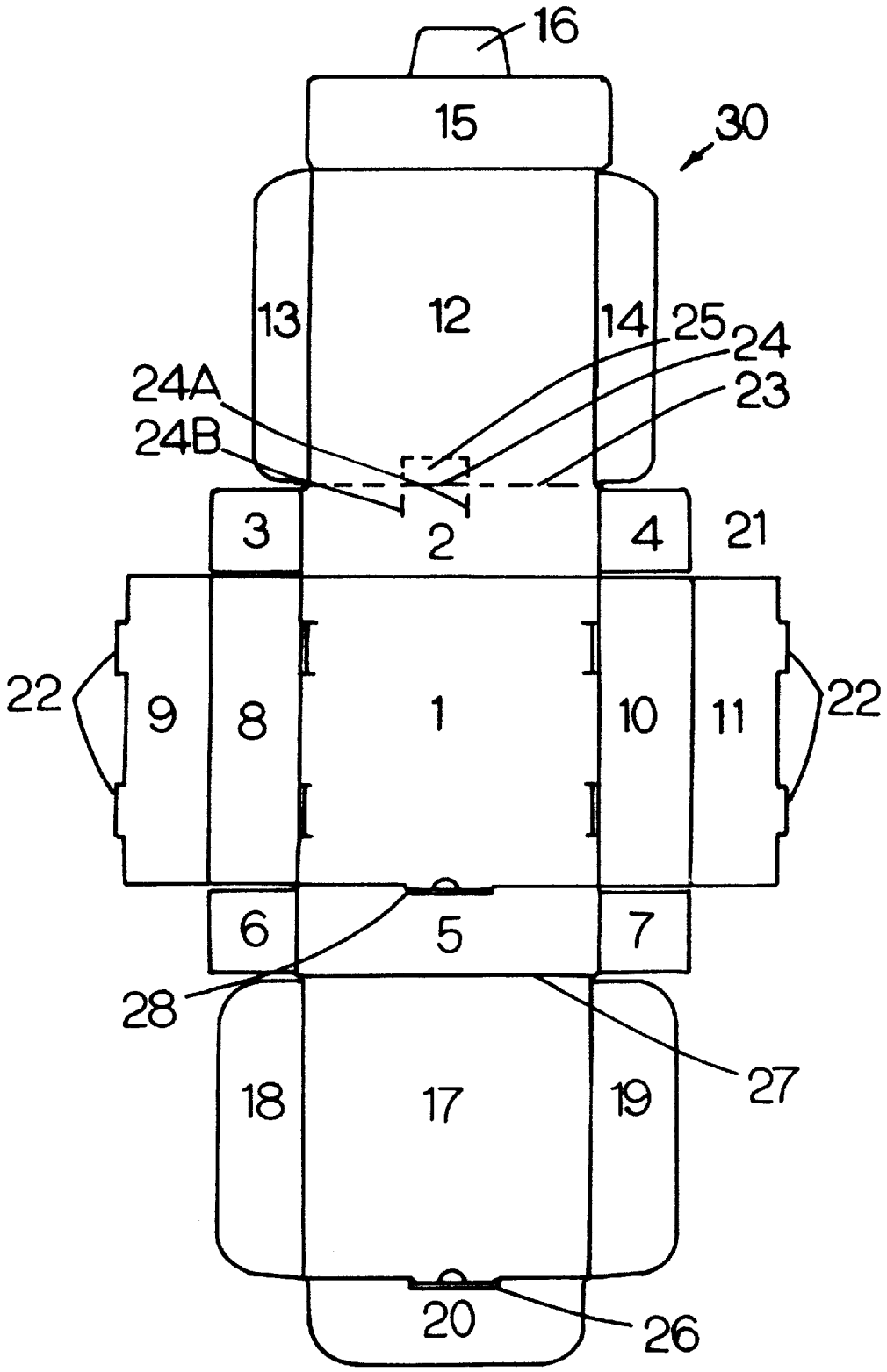
FIG. 1 shows a cardboard blank 30, lying flat, prior to assembly into a box. It can be folded and assembled into a case-like folding box, with both an inner lid, and a removable outer lid.

The spread out one-piece cardboard blank 30, shown in FIG. 1, consists of a rectangular bottom panel 1. Four side walls 2, 5, 8 and 10 are attached to the four edges of the rectangular bottom panel 1, as shown. The seams between the bottom panel 1 and the four side walls are formed by foldable borders, created by means such as using a roller to create a straight-line indentation in the cardboard, so that the cardboard will bend at each of the four borders that surround (and define, as boundaries) the bottom panel 1.

In the particular embodiment shown in FIG. 1, two of the side walls, 8 and 10, which face one another on opposite sides of the bottom panel 1, are each extended to form two reinforcing side walls, 9 and 11. These reinforcing side walls 9 and 11 will be folded in a manner that causes them to lie flat against side walls 8 and 10, respectively. Each of the reinforcing side walls 9 and 11 is provided with one or more extending tabs 22 at its outer edge, which will fit into accommodating slots 21, which are positioned in or adjacent to the folding borders between the bottom panel 1 and the side walls 8 and 10.

Both of the two additional side walls 2 and 5 (referred to for convenience as end walls 2 and 5) are also attached to the bottom panel 1, at foldable seams. The two lids 12 and 17 are attached to the end walls 2 and 5, at the opposite ends of the walls 2 and 5 from the bottom panel 1.

The lid 12 is designated herein as the "outer lid" 12, since it can be easily removed from the assembled box 30. This outer lid 12 is linked with its side wall 2, via a perforated folding border 23. This perforated border 23 allows the outer lid to be conveniently torn off, once it is no longer needed. By contrast the "inner lid" 17 is connected with its side wall 5 via a conventional folding border 27, which is indented for folding purposes, but which is not perforated.

The outer lid side panels 13 and 14 are optional, and will be preferred in settings where they are needed to help provide secure closure of the box. Similarly, inner lid side panels 18 and 19 can also be provided whenever desired.

The inner lid 17 can be provided with a conventional end flap 15, if desired. However, the outer lid 12 will need to be provided with a different arrangement, such as outer end panel 15, as shown, which is designed to lie on top of end panel 5 when the box is fully assembled and closed. Extending tab 16 can be inserted into accommodating slot 28, to secure closure of the fully assembled box.

To provide increased strength and stability, and to help close and seal the various corners of an assembled box, side wing panels 3 and 4 (attached to end wall 2) and 6 and 7 (attached to end wall 5) can also be provided. To provide greater strength and stability, wing panels 3 and 6 can be inserted between the side wall 8 and the reinforcing side wall 9, when the walls 8 and 9 are being folded into position. Similarly, wing panels 4 and 7 can be inserted between the side wall 10 and the reinforcing side wall 11, during the folding of the box.

After the side walls have been fully formed (by raising the side walls 8 and 10; properly positioning the wing panels 3, 4, 6, and 7, which requires raising end walls 2 and 5; and then, folding the reinforcing side walls 9 and 11 over the wing panels, until the side wall tabs 22 are secured in the side slots 21), the box will be in an open-tray configuration. The inner lid 17 is then folded over the open tray, towards the bottom panel 1. In this way, the box is closed for the first time, and the inner lid side and front panels 18, 19, and 20 should fit snugly inside the side 8/9 and 10/11, and against the end wall 2. Inner lid 17 preferably should carry (on the side which is not shown, in FIG. 1) the necessary lettering (or other information, such as an address blank that is to be filled out by the purchaser) for redispatching the box after the outer lid 12 has been torn off.

After the inner lid 17 has been closed, the outer lid 12 is then closed over it, in a manner which covers and hides the inner lid 17. Side panel 13 can be inserted between the side wall 8/9 (which rises from the bottom panel 1) and the inner lid side panel 18. Similarly, side panel 14 can be inserted between the side wall 10/11, and the inner lid side panel 19. When folded down, the end panel 15 will lie outside (and will cover and conceal) the end wall 5. As noted above, an end tongue 16 can be inserted into an accommodating slot 28, located within the folding border between the bottom 1 and the end wall 5, to secure safe closure of the box. The outer lid 12 will lie immediately on top of the inner lid 17.

After a first transport or delivery operation has been completed (for example, after a customer has purchased the box and any enclosed items, from a store, and has carried the box back to his house, apartment, office, or other such location), then at some point in time, a redispatch operation may become desirable. If and when this occurs, the outer lid 12 can be conveniently torn off, along the perforated folding border 23. The outer lid 12 (along with side flaps 13 and 14, end flap 15, and tongue 16) can be discarded, recycled, or otherwise disposed of. After that, there remains a simple box, with the inner lid 17 remaining as the only lid.

A pre-punched tongue 25, which can straddle the perforated border 23, and a slot 26 which is incorporated into the folding border between the inner lid 17 and its front panel 20, can be provided if desired, to help secure closure of the box after the outer lid 12 has been torn off. If provided in this manner, tongue 25 comes into play only after the outer lid 12 has been torn off. Leading off from both of the side edges of the non-perforated area 24 of the folding border 23, the side wall 2 can be slightly pierced by two cuts 24*a* and 24*b*, to ease the insertion of tongue 25 into slot 26 later.

If desired, a socket-like inset, in which various devices (such as plastic containers, for enclosing fluid or soil samples) can be secured or affixed, can be placed inside the box, in any desired manner. Depending on the intended use of the box, it might rest freely on the bottom panel 1. Alternately, an inset piece can be designed to be wedged securely into the box, using folded side edges which press firmly against the side and end walls of the box, both to stabilize the box, and to prevent any undesired motion of both the inset and any devices or components it helps secure in place.

If desired, a folding box with inner and outer lids as disclosed herein can also be made out of a thermoplastic material, appropriate for film-hinge formation, instead of cardboard. Polyethylene and polypropylene offer examples of suitable thermoplastic materials for such constructions.

Thus, there has been shown and described a new and useful folding box, with inner and outer lids designed to facilitate reliable redispatching operations. Although this invention has been exemplified for purposes of illustration and description by reference to certain specific embodiments, it will be apparent to those skilled in the art that various modifications, alterations, and equivalents of the illustrated examples are possible. Any such changes which derive directly from the teachings herein, and which do not depart from the spirit and scope of the invention, are deemed to be covered by this invention.

We claim:

1. A convertible folding box comprising:

(a) a bottom panel;

(b) side walls rising from the bottom panel;

(c) an outer lid linked with one of the side walls via an outer first folding border, for closure of a space formed by the bottom panel and the side walls; and, (d) at least one inner lid which is provided with a lettering suitable for redispatching and which is also linked with one of the side walls via an outer second folding border, and which is positioned below the outer lid, during initial display of the box, wherein the first folding border is provided with weakening means, thereby allowing the outer lid to be conveniently torn off.

2. The convertible folding box according to claim 1, wherein at least one area of the first folding border is excluded from the weakening and a tongue is left at the non-weakened area of the folding border after tearing off the outer lid, wherein the tongue which remains after tearing off of the outer lid is aligned with an accommodating slot which facilitates closure of the inner lid after the outer lid has been torn off.

3. The convertible folding box according to claim 1, wherein the box is formed out of a single cardboard panel.

4. The convertible folding box according to claim 1, wherein the box is formed out of a thermoplastic material appropriate for film hinge formation.

5. The convertible folding box according to claim 1, wherein the box is used as a packaging container which holds an enclosed sampling set that facilitates gathering and transport of samples, wherein the box and the enclosed sampling set are designed for display and purchase in a store, and wherein the outer lid of the box is provided with lettering that advertises the enclosed sampling set.

6. The convertible folding box according to claim 1, wherein the box is used as a packaging container for a sampling set that is designed to transport at least one sample, for analytical purposes, which concerns a user's state of health.

7. One-piece folding box blank comprising (a) a bottom panel;

(b) side walls rising from the bottom panel, attached to the bottom panel via folding borders, and foldable towards the bottom;

(c) an outer lid which is linked via an outer first folding border with one of the side walls; and, (d) an inner lid which is linked via an outer second folding border with one of the other side walls, wherein (i) the outer lid as well as the inner lid, lying on one another, close the space formed by the bottom and the side walls when the folding box blank has been folded into a volume-enclosing box configuration, and wherein (ii) the first folding border is weakened, in a manner which allows the outer lid to be torn off without requiring any tools.

* * * * *